United States Patent [19]

Akerblom

[11] 3,930,897

[45] Jan. 6, 1976

[54] METHOD OF TREATING AN OBJECT OF SILICON STEEL PROVIDED WITH AN INSULATING PROTECTIVE COATING OF SILICATE WITH A SOLUTION OF PHOSPHATE

[75] Inventor: Carl-Artur Akerblom, Surahammar, Sweden

[73] Assignee: Allmanna Svenska Elektriska Aktiebolaget, Vasteras, Sweden

[22] Filed: Oct. 25, 1974

[21] Appl. No.: 518,149

[30] Foreign Application Priority Data

Nov. 1, 1973 Sweden ..... 7314861

[52] U.S. Cl. ..... 148/6.15 R; 148/6.16; 148/113

[51] Int. Cl.[2] ..... C23F 7/10

[58] Field of Search ..... 148/6.15 R, 6.16, 6.17, 148/113

[56] References Cited

UNITED STATES PATENTS

| | | | |
|---|---|---|---|
| 2,753,282 | 7/1956 | Perry | 148/6.16 |
| 2,835,618 | 5/1958 | Keller et al. | 148/6.15 R |
| 3,615,918 | 10/1971 | Evans et al. | 148/113 |
| 3,658,587 | 4/1972 | Miller | 148/6.16 X |

*Primary Examiner*—Ralph S. Kendall

[57] ABSTRACT

An object of silicon steel, such as sheet and strip for motors, generators and transformers, which has an insulating coating of silicate, is provided with a solution of phosphate by applying to the silicate-coated object an aqueous solution containing phosphate ions and complex metal-ammonia ions and heating the coated object to a temperature of at least about 550°C for a time sufficient to anchor the resulting phosphate layer to the silicate coating. The solution has a pH-value of at least 9, and consists essentially of monophosphate ions. The metal ions are cupric ions and/or chromic ions. An insoluble filler may be added to the aqueous solution.

4 Claims, 2 Drawing Figures

METHOD OF TREATING AN OBJECT OF SILICON STEEL PROVIDED WITH AN INSULATING PROTECTIVE COATING OF SILICATE WITH A SOLUTION OF PHOSPHATE

BACKGROUND OF THE INVENTION

1. Field of the Invention

The invention relates to a method of treating an object of silicon steel having an insulating protective coating of silicate with a solution of phosphate.

2. The Prior Art

In the manufacture of sheet material of silicon steel, so-called electrical sheet, with grain orientation, the sheet material is subjected after rolling and decarburization to a heat treatment at about 850° to 1350°C in order to achieve a grain growth of the crystals which is necessary for the sheet material to acquire the required magnetic properties.

Before the heat treatment the sheet material is coated with chemicals which are to form an electrically insulating protective coating on the sheet material during the heat treatment process. One such known protective coating may consist of a reaction product of silicon dioxide formed at the surface of the sheet material and an applied oxide or hydroxide of an alkaline earth metal, usually magnesium. The application of the protective coating on the surface of the sheet material is carried out by suspending the alkaline earth metal oxide or hydroxide in water and applying it onto the sheet material in an even layer, after which the sheet is subjected to the previously mentioned heat treatment at a temperature of around 850°C to 1350°C in hydrogen atmosphere for several hours. However, in order to ensure that a well-developed glass film is formed on the sheet material the temperature should amount to around 1000°C to 1350°C. The hydroxide which is part of the suspension from the start or which is formed from the oxide by liberation of water liberates water while the sheet material is being heated, which water, at temperatures below that mentioned above, is able to oxidize silicon in the steel to silicon dioxide without simultaneously oxidizing the iron. The oxide which is formed from the hydroxide during the liberation of water or which is possibly added from the start and has escaped hydration, reacts with the silicon dioxide during the heat treatment while forming the previously mentioned well-developed glass film on the surface of the sheet material. The glass film can also be obtained by using a carbonate of an alkaline earth metal. The carbon dioxide which the carbonate liberates during heating is able to oxidize silicon into silicon dioxide without the iron being oxidized. When the silicon dioxide has been formed, the formation of glass proceeds in the manner described above. Any excess of the oxide which has not reacted during the glass formation acts as spacing material between adjacent layers of the sheet, whether these are present as turns in a roll or as laminae in a stack, and it prevents the layers from sticking or sintering together.

A protective coating of silicate as described above has an insulating resistance which is insufficient for many purposes, and therefore the protective coating is often reinforced by treatment with phosphoric acid and metal phosphates, especially alkaline earth metal phosphates, and the solution must be acid in order that the phosphates might be kept dissolved.

When applying phosphates on the said protective coating of silicate by known methods, the protective coating may become porous. This is due to the phosphate penetrating into the silicate layer and loosening it up. The penetration of the phosphate also causes the otherwise good adhesion of the coating to the sheet to deteriorate and also the tenacity of the coating and thus its resistance to, e.g., bending to deteriorate. The loosening of the protective coating also causes it to be easily broken away from the sheet during the subsequent annealing at around 800°C, which is carried out in order to remove inner tensions in the sheet. In this operation gases may penetrate into the sheet material, owing to the porosity of the protective coating, thus causing the unfavourable effect.

SUMMARY OF THE INVENTION

According to the present invention it has proved possible to effect an application of a phosphate layer which is effectively anchored to the protective coating of silicate, without loosening this protective coating and deteriorating its adhesion to the sheet.

The present invention relates to a method of treating an object of silicon steel, such as in the form of sheet and strip for motors, generators and transformers, provided with a protective coating of silicate with a solution of phosphate, characterised in that an aqueous solution containing phosphate ions and complex metal-ammonia ions is used as phosphate solution.

The phosphate solution preferably has a pH value of at least 9 and the phosphate ions preferably consist of monophosphate ions.

The metal ions of which the complex metal ions are built up with the ammonia primarily consist of cupric and chromic ions. As examples of complex ions in the phosphate solution according to the present invention may be mentioned cupric ammonium ions, $Cu(NH_3)_4^{2+}$, and chromic ammonium ions, $Cr(NH_3)_6^{3+}$.

One explanation of the favourable result obtained according to the present invention is the following: When applying phosphate from an acid solution in a known manner, the solution contains $H_3PO_4$. During heating of the coated sheet the loosening of the silicate coating by the action of $H_3PO_4$ starts already at 80°C and then continues increasingly stronger when the temperature is being raised as long as there is water left. When the temperature is further raised phosphoric acids are formed with an increasingly lower water content and with a decreasing penetrative capacity in the silicate coating, and finally $HPO_3$. $HPO_3$ is partly driven off and diffuses partly into the silicate coating, causing damage to this. $HPO_3$ also gives rise to the formation of metal phosphates by reaction with the silicate in the silicate coating. By adding ammonia according to the present invention the unfavourable effect of $H_3PO_4$ and other phosphoric acids is eliminated. Instead of this, harmless ammonium phosphates are formed, which are intact as long as the water remains and which are disintegrated at higher temperatures without leaving remnants in the form of harmful acids. In addition to this, complex metal ions are formed which keep the phosphates in solution, which is important for achieving an even coating. Also these compounds with complex linked ammonia are disintegrated at higher temperatures while giving off ammonia and liberating metal phosphates. These phosphates do not penetrate through the silicate coating but are deposited on the surface with some diffusion into the silicate coating, which provides an efficient anchoring there. The solvent is gone when the last-mentioned process is going on. The indiffusion is due to the fact the the formed phosphate has a certain solubility in the silicate in the protective coating. Particularly favourable results are obtained if the starting materials are chosen so that metaphosphates are formed during the heat treatment because metaphosphates are extremely easily anchored in the silicate at temperatures normally used for phosphate coatings. The used phosphate solution should therefore, in additon to the complex metal ions, i.e. e.g. $Cu(NH_3)_4^{2+}$-ions or $Cr(NH_3)_6^{3+}$-ions, preferably contain phosphate ions in the form of monophosphate ions, i.e. $H_2PO_4^-$-ions.

The metal phosphates applied according to the invention provide the favourable properties which are charateristic of a phosphate coating, namely high insulating resistance, high resistance to chemicals such as transformer oil and a good ability to act as adhesion agents for plastics, which is an advantage in case of embedments in plastics which may occur when manufacturing dry-insulated transformers. Because of the extremely good adhesion between the silicate coating and the sheet obtained according to the present invention, the silicate coating may hold the finished sheet in mechanical tension due to the fact that it has a lower coefficient of thermal expansion than the sheet, thus reducing the remagnetization losses.

The application of the silicate coating onto the object of silicon steel may be performed in a conventional manner, for example by applying on the object particles of an oxide, a hydroxide or a carbonate of an alkaline earth metal and subjecting the object with the applied particles to heating to at least 850°C, preferably to 1000°C to 1350°C in nitrogen gas, hydrogen gas or another inert or reducing atmosphere. When using an oxide also a substance capable of oxidizing silicon to silicon dioxide is used simultaneously, usually water bound to the alkaline earth metal as hydroxide. As alkaline earth metal magnesium is particularly preferred, but also calcium, barium and strontium may be used. The thickness of the protective coating is from monomolecularly up to around 10 microns, for particularly favourable results 0.1 to 5 microns and preferably 0.1 to 1 micron. Before applying the phosphate the excess of alkaline earth metal is brushed away from the object.

The application of the phosphate layer is made by applying the phosphate solution onto the object provided with the silicate coating, after which the object is heated to a temperature of at least 550°C, suitably to 550°C to 1100°C and preferably to 700°C to 850°C for at least ½ minute, preferably for a period of from ½ minute to 10 minutes. Longer periods are not harmful. The heating can be made in oxidizing, reducing or inert atmosphere, i.e. the atmosphere is not critical. Air can be used with advantage.

To the phosphate solution there may be added insoluble fillers such as colloidal silica, the grain size of which is normally less than 16 millimicrons, or mica powder, the grain size of which is normally lower than 10 microns. By the addition of fillers the resistivity of the protective coating is increased.

The content of phosphate ions, complex metal ions, ammonium ions and dissolved ammonia amountes to 5 to 50 per cent by weight and preferably 20 to 40 per cent by weight of the total weight of said constituents and solvent, which completely or for the main part consists of water. The solution can also contain other negative ions, which are not included in the contents above, such as sulphate, nitrate and acetate ions which are derived from suitable metal salts for supplying the metal ions to the solution. The content of starting materials used which give complex metal ions and phosphate ions in the solution is adjusted so that the phosphate remains in solution and is later effectively anchored to the silicate coating normally so that the phosphate is present essentially as monophosphate ions. The addition of ammonia or other ammonium compound such as ammonium hydroxide is adjusted so that complex formation of the metal ions is obtained and precipitation thereof is avoided. This requires an addition corresponding to a pH-value of at least 9.

If fillers are added to the phosphate solution, the content of fillers suitably amounts to 5 to 50 per cent by weight and preferably to 10 to 30 per cent by weight of the total weight of fillers, phosphate ions, complex metal ions, ammonium ions, dissolved ammonia and solvent.

The thickness of the phosphate layer is 0.1 to 20 microns, for especially favourable results 0.5 to 5 microns and preferably 1 to 3 microns.

BRIEF DESCRIPTION OF THE DRAWINGS

The invention will be explained more closely by way of a number of examples with reference to the accompanying drawing, in which FIG. 1 schematically shows a means for the application of the protective coating of silicate onto a sheet and.

DESCRIPTION OF THE PREFERRED EMBODIMENTS

Figure 1:
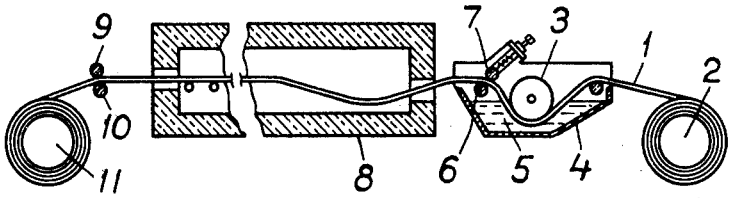

In FIG. 1, 1 designates a sheet of silicon steel which has been pre-treated to give grain orientation and which has been decarburized at 720°C–900°C, preferably at 800°C, in wet hydrogen atmosphere. It has a thickness of 0.3 mm. The sheet is drawn from a coil on a reel 2 and passes under a roll 3 which rotates in a pan 4 containing a suspension 5 of the particulate material with which the sheet is to be coated. The suspension 5 can, for example, be manufactured by suspending 90 parts by weight of magnesium oxide consisting of particles which up to 95 per cent by weight have a grain size less than 5 microns and for the rest a grain size less than 25 microns in 1000 parts by weight water. After passing the pan 4 the sheet is passed between wiping rollers 6 and 7, which are suitably rubber-clad, and into a furnace 8 where it is dried at a temperature of about 100°C for about 30 seconds before it is coiled up on the reel 11 after having passed the transport rollers 9 and 10. Thereafter the sheet is annealed at high temperature in a batch annealing furnace at around 1000°C to 1350°C in hydrogen atmosphere for several hours, after which a protective coating of silicate with a thickness of 1 micron is formed on the sheet.

Figure 2:
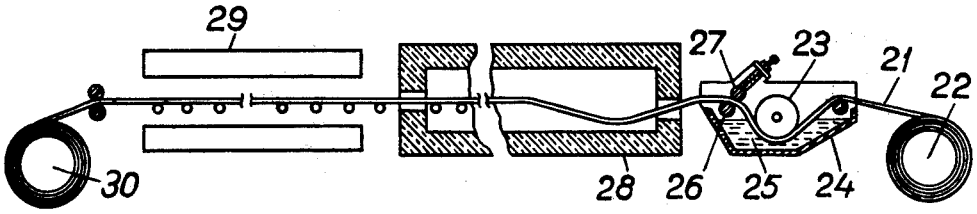
FIG. 2 schematically a means for the application of a phosphate coating according to the present invention onto the sheet provided with the protective coating of silicate.

When the sheet, which has been treated in the means according to FIG. 1, has been liberated from excess coating by brushing, it is coated with phosphate in the means according to FIG. 2. The sheet, which is there designated 21, is drawn from a reel 22 and passes under a roll 23 rotating in a pan 24 with a solution 25 of phosphate in water, possibly containing suspended filler. The sheet is then passed between the wiping rollers 26 and 27 which are suitably rubber-clad and into a furnace 28, after which the sheet is cooled by a cooling device 29, before it is coiled up on the reel 30. The concentration of phosphate in the treatment liquid 25 is adjusted with regard to the profile of the rubber rollers 26 and 27 and to the roller pressure so that the desired thickness of the phosphate layer is obtained. For all the compositions of the solution 25 exemplified below, the furnace 28 has a temperature of 800°C and the time for the sheet to pass through the furnace is 2 minutes. The furnace atmosphere is air. The thickness of the phosphate layer in the exemplified cases is 2 microns. Examples of the preparation of the solution 25 are given in the following.

EXAMPLE 1

20 parts by weight of crystallized copper sulphate is dissolved in 100 parts water to which 10 parts concentrated phosphoric acid (i.e. containing 85 per cent by weight $H_3PO_4$ and the rest water) and ammonia (aqueous solution containing 25 per cent by weight ammonia) to a pH-value of 10 are added. To this there is further added 115 parts of a suspension containing 40 per cent by weight colloidal silica in water ("Syton" from Monsanto, USA). The copper will then form a complex ion, a cupric ammonium ion, with the ammonium, and is therefore kept in solution. The phosphate is present as monophosphate ion.

EXAMPLE 2

30 parts by weight of crystallized chromium-III-nitrate is dissolved in 100 parts water to which 10 parts concentrated phosphoric acid (85%) is added. The solution is boiled and evaporated until practically all nitric acid has boiled off. Thereafter ammonia is added to a pH-value of 10. Further there is added 115 parts of a suspension of colloidal silicia of the same type as described in Example 1. The chromium then forms a complex ion, a chromic ammonium ion, with the ammonia and is therefore kept in solution. The phosphate is present as a monophosphate ion.

EXAMPLE 3

15 parts by weight of crystallized chromium-III-nitrate and 15 parts by weight of crystallized copper sulphate are dissolved in 100 parts of water. 10 parts of concentrated phosphoric acid (85%) and ammonia are added to the solution to a pH-value of 10. The copper and the chromium are kept in solution as complex ions and the phosphate is present as monophosphate ion.

EXAMPLE 4

20 parts by weight of crystallized chromium-III-phosphate and 10 parts of concentrated phosphoric acid (85%) are mixed with 100 parts of water. Ammonia is added to this mixture to a pH-value of 10. The chromium is then kept in solution as a complex ion and the phosphate is present as a monophosphate ion.

EXAMPLE 5

20 parts by weight of crystallized copper sulphate is dissolved in 100 parts of water to which 10 parts of concentrated phosphoric acid (85%) and ammonia to a pH-value of 10 are added. Further there is added 10 parts of mica powder with a particle size of less than 10 microns. The copper is thus kept in solution as a complex ion and the phosphate is present as a monophosphate ion.

I claim:

1. Method of producing a phosphate coating on an object of silicon steel having an insulating coating of silicate, with a solution of phosphate, which comprises coating the object with an aqueous solution containing phosphate ions and complex metal-ammonia ions consisting essentially of cupric and/or chromic ions, said aqueous solution having a content of phosphate ions, complex metal ions, ammonium ions and dissolved ammonia of together 5 to 50 per cent by weight, the solution having a pH of at least 9, and heating the coated object to a temperature of at least about 550°C for a time sufficient to anchor the resulting phosphate layer to the silicate coating.

2. Method according to claim 1, in which the phosphate ions consist essentially of monophosphate ions.

3. Method according to claim 1, which comprises heating the object with the applied phosphate solution to a temperature of 700°to 850°C.

4. Method according to claim 1, in which the solution contains an insoluble filler.

* * * * *